US008853513B2

(12) United States Patent
Kernick

(10) Patent No.: US 8,853,513 B2
(45) Date of Patent: Oct. 7, 2014

(54) VIBRATO SYSTEM FOR STRINGED MUSICAL INSTRUMENTS

(71) Applicant: Edward R Kernick, Jacksonville, FL (US)

(72) Inventor: Edward R Kernick, Jacksonville, FL (US)

( * ) Notice: Subject to any disclaimer, the term of this patent is extended or adjusted under 35 U.S.C. 154(b) by 0 days.

(21) Appl. No.: 13/830,630

(22) Filed: Mar. 14, 2013

(65) Prior Publication Data

US 2013/0239771 A1 Sep. 19, 2013

Related U.S. Application Data

(60) Provisional application No. 61/611,273, filed on Mar. 15, 2012.

(51) Int. Cl.
*G10D 3/00* (2006.01)
*G10D 3/14* (2006.01)

(52) U.S. Cl.
CPC ..... *G10D 3/14* (2013.01)
USPC ..... 84/313

(58) Field of Classification Search
CPC ..... G10D 3/04; G10D 7/02; G10D 3/143; G10D 1/08
USPC ..... 84/312 R, 313, 307–309
See application file for complete search history.

(56) References Cited

U.S. PATENT DOCUMENTS

| | | | | |
|---|---|---|---|---|
| 2,802,386 A * | 8/1957 | Crosby | ..... | 84/726 |
| 6,084,166 A * | 7/2000 | Lee | ..... | 84/313 |
| 2006/0021492 A1 * | 2/2006 | Burchfield | ..... | 84/304 |

* cited by examiner

*Primary Examiner* — Kimberly Lockett
(74) *Attorney, Agent, or Firm* — Chimeric Innovation Law, PLLC; Camille Anjes Higham

(57) ABSTRACT

The subject matter of the present invention is a vibrato device which can be used in most stringed musical instruments as an integral unit to effectively vary and return the instrument to pitch/in tune. The vibrato device can include a plurality of flush tension springs, a mounting plate and a pivoting element to change the tension of the strings and change tune accordingly. Additionally, the combination of the mounting plate and pivoting bridge element can allow for easy interchangeable parts when desired and for strings to stay in pitch in the event one or more strings break.

9 Claims, 6 Drawing Sheets

VIBRATO SYSTEM FOR STRINGED MUSICAL INSTRUMENTS

FIELD OF THE INVENTION

The present invention is related to a method and Vibrato device to effectively return to pitch/in-tune stringed musical instruments. More specifically, the improved method and Vibrato Device may be integrated in stringed musical instruments, for example guitars, to effectively return the instrument to pitch, with friction stability, and in a practical way.

BACKGROUND OF THE INVENTION

Most stringed musical instruments do not come standard with a vibrato unit. Recently a number of vibrato units have been developed. These mechanisms are used to alter the pitch on stringed musical instruments, for example, in electric guitars. They are usually mounted on solid body electric guitars by anchoring them into the guitar to allow the user to vary the pitch by depressing the vibrato unit's arm, which lowers the pitch, and by letting the arm return to its original position, thereby raising the pitch to its original setting.

Many users opt out of using these aftermarket vibrato device units because most of significant drawbacks that the current systems have. For example, some units cause the instrument to go out of tune. Units that have tried to keep this from happening require complex systems that alter the body of the guitar, add weight and decrease the value of the guitar.

A free floating tremolo is an example of a vibrato system that has been recently developed and seeks to improve some of the current systems. Nevertheless, in this system when a string is broken, the combined load of the strings is less than the combined load in the springs, therefore, the return springs over compensate and pull the tremolo back past an equilibrium point, causing an strings to go out of tune. When this happens it is impossible to continue playing until the song is over. To continue playing, the broken string needs to be replaced. This requires retuning all of the strings and it takes a screwdriver, or Allen wrench, to release the clamp on the nut on some instruments, before the tuners can be turned to tighten or release the tension in the strings.

Another problem with the new systems is setting the intonation. This is done in most current systems by varying the distance between the bridge segments on the tremolo and the nut on the neck of the instrument. This is where the strings make contact on the instrument without being depressed. The longer the span between these points the lower the pitch, and the shorter the distance between these points the higher the pitch. The instrument can be in perfect tune when the strings are picked open, for example the little E string, but when moving up to the twelfth fret and picking the little E string it may or may not be in tune, depending on where the bridge segments have been set. This is also true for all of the other strings in their own respective keys resulting in a long time consuming job for adjustment of the intonation. This requires the use of an Allen wrench or screwdriver, and the loosening up of the string, setting the bridge segments, retuning, and checking with an electronic tuner to see if the first guess was okay. This can go on four or five times with each string.

The complications mentioned are even compounded more when a new set of strings are installed. If a string breaks while playing in a concert on fixed bridge tremolos, good players can just brush it out of the way, and improvise using the appropriate other strings until the song is over. On some mounted tremolos, breaking a string causes all the other strings to go out of tune, and improvising using the other appropriate strings until the song is over is next to impossible. It then becomes a major job to replace the string and retune the instrument.

As previously explained, many limitations and disadvantages exist with relation to these existing units. As a result, there exists a need for an improved effective Vibrato Device that is may be practically integrated in guitars and other stringed musical instruments, to effectively return the instrument to pitch, with friction stability, and that is capable of dropping one or more notes as it may be desired.

SUMMARY OF THE INVENTION

Accordingly, the present invention provides for an improved vibrato device and methods of implementing said vibrato device. The vibrato device of the present invention may be used in most stringed musical instruments with a curved or flat playing surface . For example, it may be incorporated in fender telecaster style guitars.

In some embodiments of the present invention, the vibrato device can be strung with standard musical instrument strings with a spool end without threading the strings through the guitar. The vibrato device can comprise a mounting plate that can easily be mounted using existing holes in the flat surface of the stringed instrument. This can allow for the system to be installed without any permanent modification to the original stringed instrument, which in some cases can significantly decrease the value of the instrument.

The mounting plate of the vibrato device can include a mating mechanism that allows the positioning of a pivoting bridge element. The pivoting bridge element can comprise a means of fixing the individual strings, one or more flush tension springs, a whammy bar receptacle and/or a fixed whammy bar.

In one aspect of the present invention, the mounting plate can include a means of adjusting tension and or controlling the degree of change in intonation. For example, in some embodiments an overall height adjustment for the pivoting bridge element can be provided. Additionally, the mounting plate may allow for easily replacement of the pivoting bridge element with another, wherein the new pivoting bridge element may include different tension springs or different number of springs that can vary the force required for the whammy bar.

In yet another aspect of the present invention, the means used to fixed the individual strings to the pivoting bridge element can include individual saddles that can also include individual height adjustments and intonation adjustments. This may be achieved in some embodiments by means of threaded fasteners.

BRIEF DESCRIPTION OF THE DRAWINGS

The accompanying drawings, which are incorporated in and constitute a part of the specification, illustrate exemplary embodiments of the invention.

DETAILED DESCRIPTION OF THE INVENTION

The present invention now will be described more fully hereinafter with reference to the accompanying drawings, in which some examples of the embodiments of the inventions are shown. Indeed, these inventions may be embodied in many different forms and should not be construed as limited to the embodiments set forth herein; rather, these embodiments are provided by way of example to better describe the present invention.

Glossary

"Vibrato Device" as used herein refers to a device that may be used to change the tension of strings in a musical instrument. In some embodiments of the present invention, the Vibrato Device can include a pivoting bridge element and a mounting plate that may be attached to the flat surface of a telecaster style guitar.

"Whammy Bar" as used herein refers to a device component of a vibrato device that can facilitate the application of force to pivoting bridge mechanical element of said vibrato device. For example, it can include a protruding bar that is conveniently located in proximity to the playing surface of the musical instrument. In some embodiments, the whammy bar may incorporate electrical components or additional mechanical components, such as an electrical switch that can act as a locking mechanism or a tune/pitch control. For example, an electrical strain gage that could electrically change the tone of the guitar.

Figure 1:
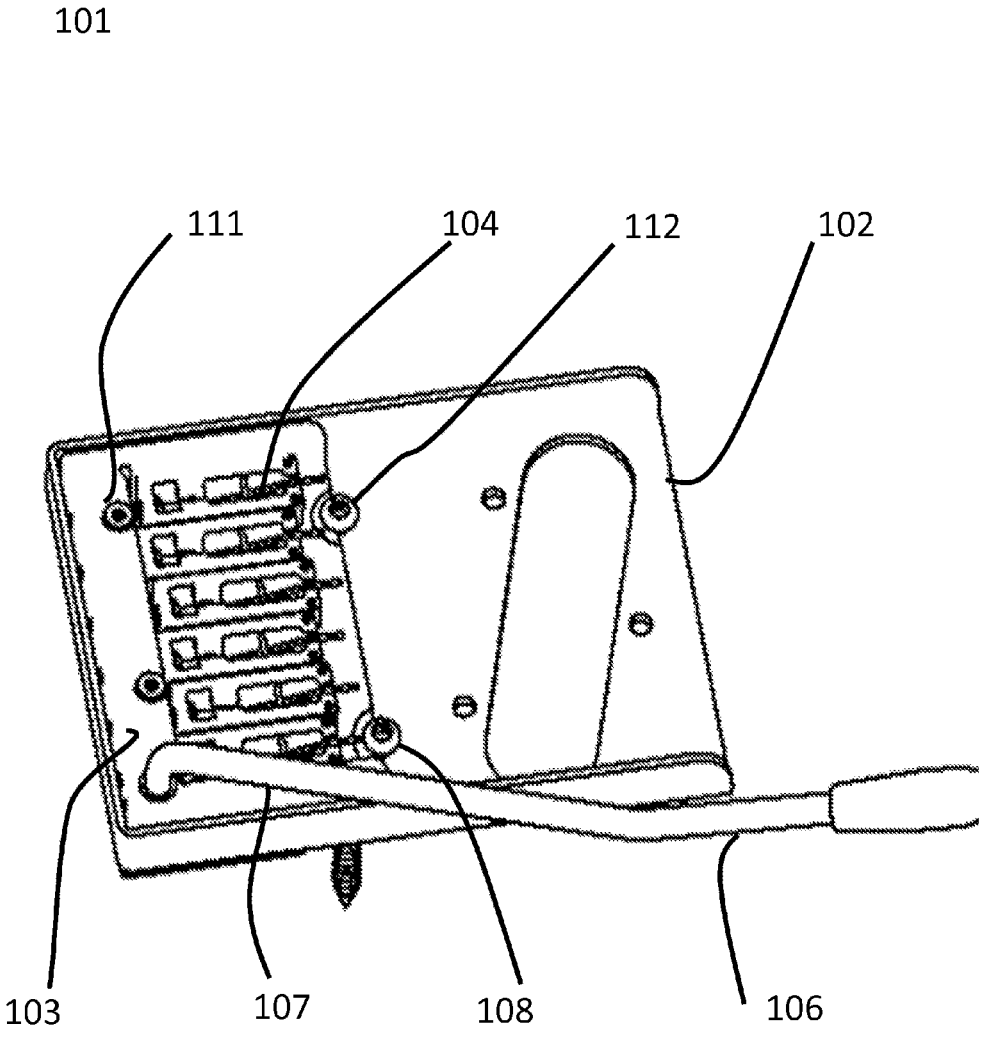
FIG. 1 illustrates a top view of the vibrato device of an exemplary embodiment of the present invention.
Figure 2:
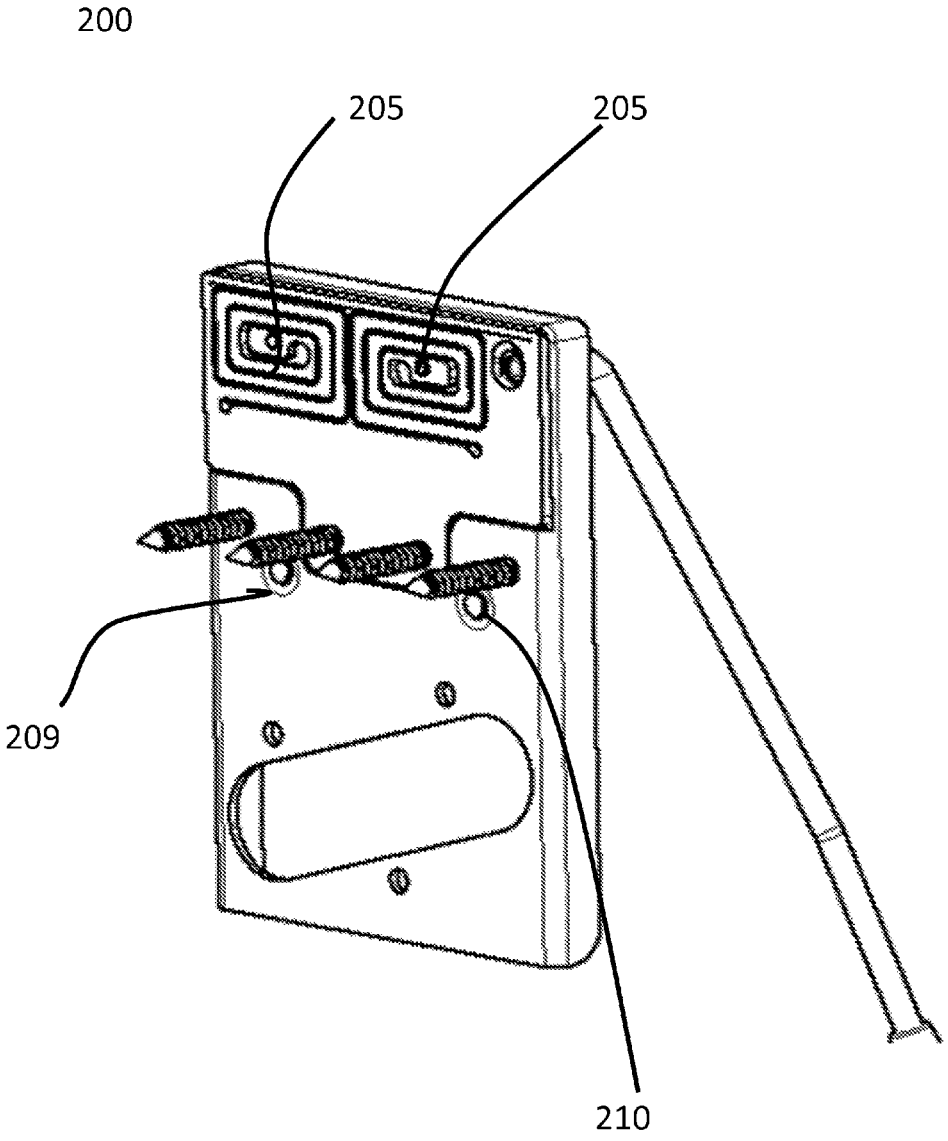
FIG. 2 illustrates an isometric perspective view of the underside of an exemplary pivoting bridge element that may be used in the present invention.

Referring now to FIG. 1, an exemplary vibrato device of the present invention is illustrated 101. At 102, the mounting of said exemplary vibrato device is depicted. Preferably, the mounting plate can be a metal piece, carbon fiber or composite that can be attached to the existing holes of a generally flat surface of the instrument using a plurality of screws as depicted in FIG. 2. FIG. 112 shows pivot bolts may include one or more jacking pivot axis bolts that allow for the mounting and/or adjustment of a pivoting bridge element 103 (further described in FIGS. 2 and 5) of the vibrato device. Further, the bolts depicted may be inserted in holes 108 in the mounting plate 102 which are aligned with existing holes in some musical instruments so that no permanent modification to the instrument is required. In other embodiments, the four mounting screws for the telecaster can be hidden under the bridge.

At 104, one or a plurality of saddles used to attach the individual strings of the instrument is depicted. In the exemplary embodiment, traditional saddles that can allow for individual height adjustments and intonation adjustments are depicted being attached to the pivoting bridge element. However, they may be attached to another piece that can accommodate the individual saddles and additionally be easily fixed to the pivoting bridge element. This would facilitate the replacement or the pivoting bridge element for another that has different a different tension and affects pitch differently, as it may be desired.

At 111, a plurality screws are depicted. The screws can function in some embodiments as tension spring adjustment screws. The tension spring adjustment screws can attach the fixed portion, in relation to the metal plate, of the pivoting bridge element to the mounting plate. Additionally, by fastening the screws at a different level, the degree of pivoting and "whammy" tension may be controlled to a certain degree. For example, each saddle can support an individual string centered in each saddle utilizing a shallow notch, preferably 1 mm. Said saddle can include means for adjusting its height above said bridge element. This feature can be two or more threaded holes through the surface perpendicular to the musical instrument's mounting surface, to receive the threaded fasteners allowing individual height adjustment of the said saddles. The said spring tension adjustment screws are fastened to the said springs in the said mounting plates through the clearance holes of the said pivoting bridge element. These screws adjust the tension of the said tension springs, counteracting the musical instrument's strings tension. The head of the fastener can be an adjustment feature such as a socket head, slot or Phillips screw head allows for spring tension adjustment.

Attached to a pivoting element within the pivoting bridge element of the vibrato system, at 107 a whammy bar is depicted. The whammy bar can include any desired feature, such as the geometric shape depicted at 106, to enable or facilitate the use of the whammy bar while playing the musical instrument. In some embodiments, the whammy bar may be metal or any rigid material. The whammy bar may be inserted into a tension bushing feature. This bushing feature can be utilized for mechanically changing the pitch of the said pivoting bridge element. Therefore changing the pitch, tune or note of the all of the said strings of the musical instrument. When the Whammy bar is released the said tension springs return the said pivoting bridge element to it's original position. Thus bringing the musical instrument back into tune.

Referring now to FIG. 2, the underside of a pivoting bridge element is depicted. At 205, two flush tension springs are depicted in the exemplary embodiment. However, the pivoting bridge element may include one, or three or more to provide a desired tension. The tension may also be varied by the thickness or material used for the pivoting bridge element springs. At 209 and 210, two pivot bolts are depicted with threaded apertures next to them for existing wood screws of the guitar. The apertures may go through both the mounting plate and pivoting bridge element or only in the mounting plate depending on the configuration desired.

Figure 3:
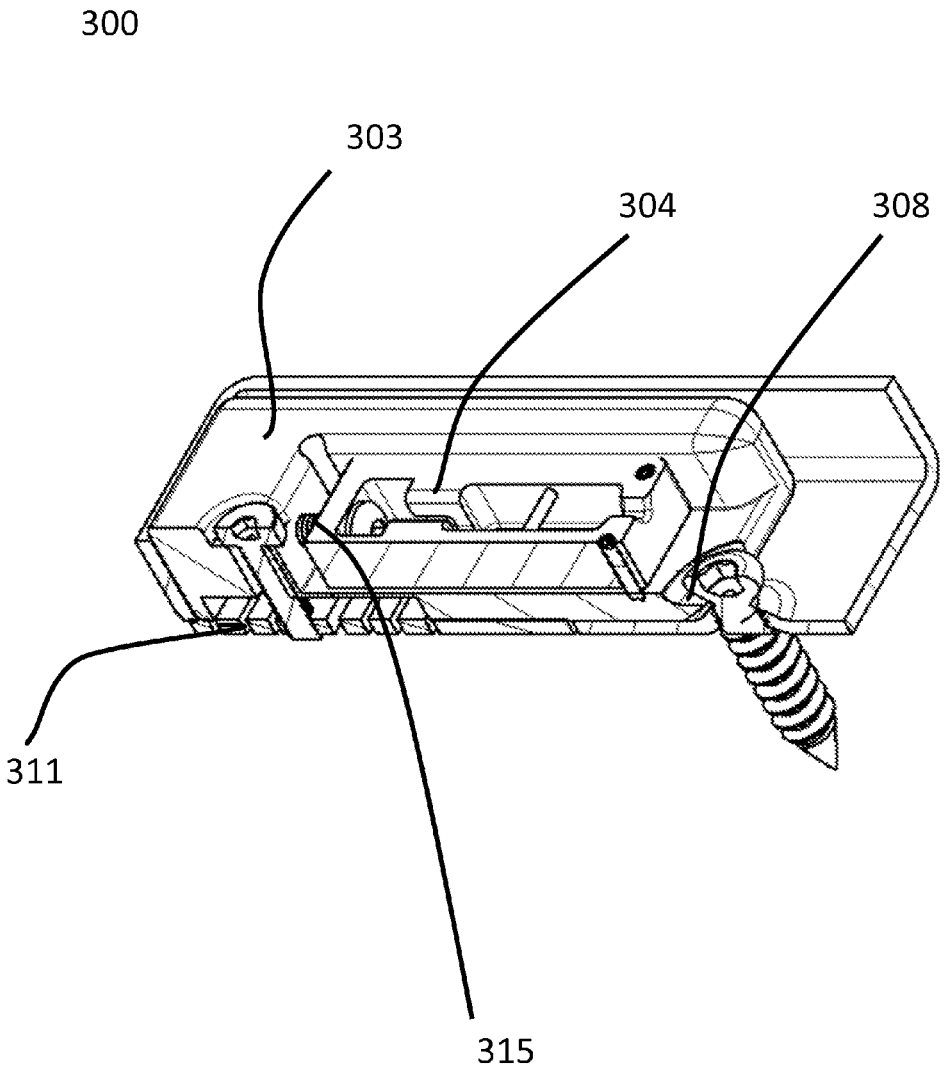
FIG. 3 illustrates a cross section view of an exemplary mounting mechanism for an exemplary embodiment of the present invention.

Referring now to FIG. 3, a cross section side view of the exemplary device of FIG. 1 is depicted. At 315, intonation holes are depicted. Said intonation holes can be threaded in the saddle and adjusted by a screw or bolt from the back of the bridge or as the exemplary embodiment depicts a threaded hole in the bridge and with each saddle has a clearance hole and a button head socket screw inside the saddle which adjust the intonation. Additionally, in some embodiments one of the holes in the saddle may have a small pin going through it so when the bridge is rotated forward, the string can stay seated. A tension spring that can also help intonation going through the pivoting bridge element 303 is depicted at 311. The pivoting bridge element includes a saddle 304 supporting an individual string centered and utilizing a shallow notch. Also depicted in the cross section, at holes in the plate 308 can accommodate said bolts in FIG. 1 at 108 wherein a feature, such as the v-cut depicted, can allow the pivoting element to move with minimal friction in relation to the fixed mounting plate.

One or more other holes may also be designed to receive the said friction bushing which is non-rigidly attached to constrains the whammy bar in rotation from the holes axis and in translation from the holes axis allowing rotation around an axis. This one or more holes are located on the surface perpendicular to the musical instrument's mounting surface with a threaded hole intersecting the said friction bushing hole from aft surface perpendicular to the orientation of the strings.

The forward edge of the said pivoting bridge element which contacts the said jacking pivot axis bolts, can utilize two notched knife edge features to allow minimal friction and a single degree of freedom for a pivotal motion. The said pivoting bridge element is designed to utilize side walls parallel the orientation of the said strings to prevent lateral motion of the said saddles. Further, the saddles can be used as a string suspension system and are attached to the said pivoting bridge element constrained by the said intonation and/or mounting screws and said flush tension spring(s). The said saddle allows enough clearance to use a standard tool to adjust the axial saddle position parallel with the string. The said saddle is designed to receive the spool end of a musical instrument's string. This can be accomplished by a double notch feature for said string ends. As a result, this vibrato device can eliminate the threading of strings through the musical instrument's body.

Figure 4:
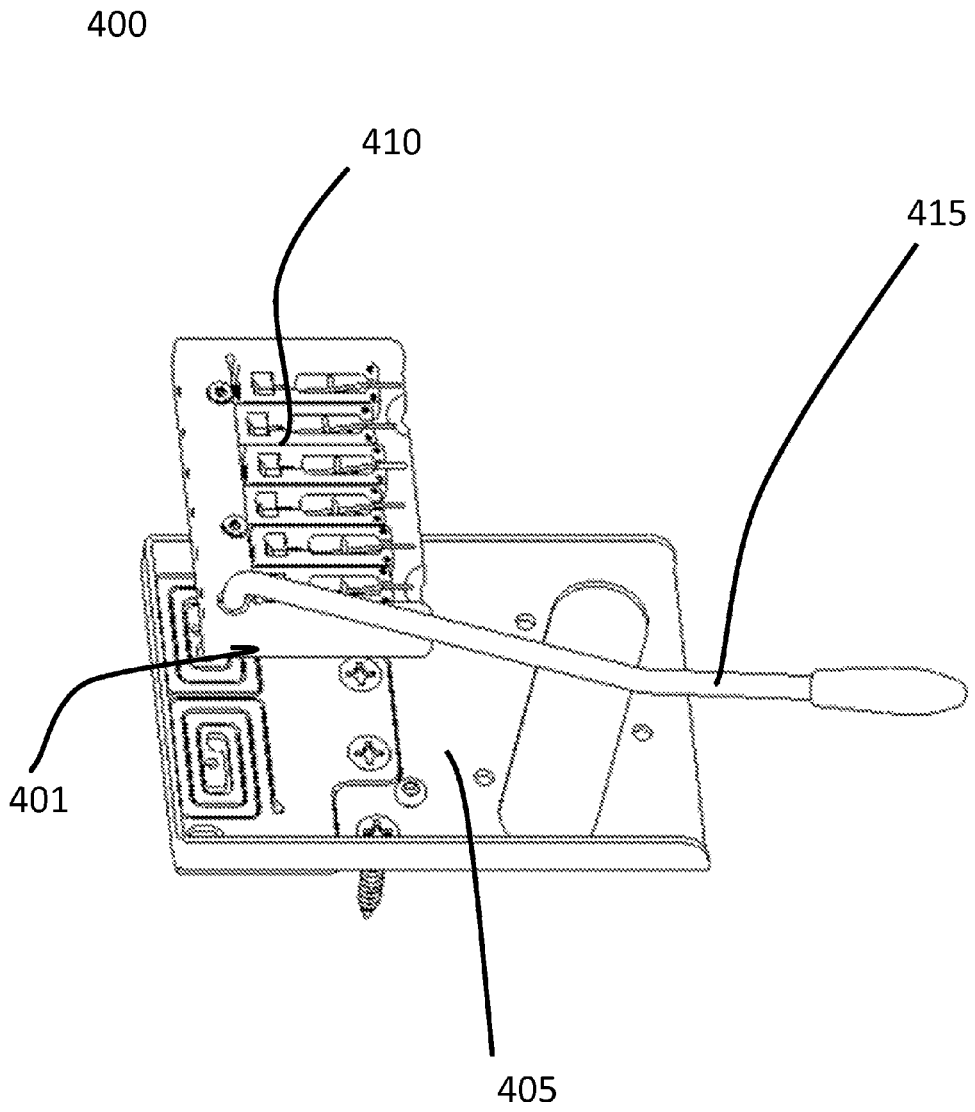
FIG. 4 illustrates an isometric view of another exemplary embodiment of the present invention.

Referring to FIG. 4, in one exemplary embodiment, the mounting plate 405 comprises a rearward walled section and a forward open center section. The rear walled section can assist in the positioning of the pivoting bridge element to prevent it from snapping out of place. In some embodiments, it may be required that the forward section of the mounting plate does not include the side wall feature to prevent it from interfering with the strings (not depicted) which are positioned right above it from the pivoting bridge element 401. Additionally, as it will be apparent to a person in the ordinary skill in the art, the whammy bar 415 and the saddles 410 may include many already commercially available parts as they may be easily removed in some embodiments. Further, it will also be apparent to a person of the ordinary skill in the art, that in some embodiments of the present invention it may just be a plate holding the pivot bolts, mounting screws and springs allowing it to be a one piece device which may be desirable for some stringed musical instruments. However, in the preferred embodiments, the vibrato system device can include the two piece device system depicted in FIG. 4 or one with more pieces as it may be desired, to provide a bendable part and a rigid spring piece.

Figure 5:
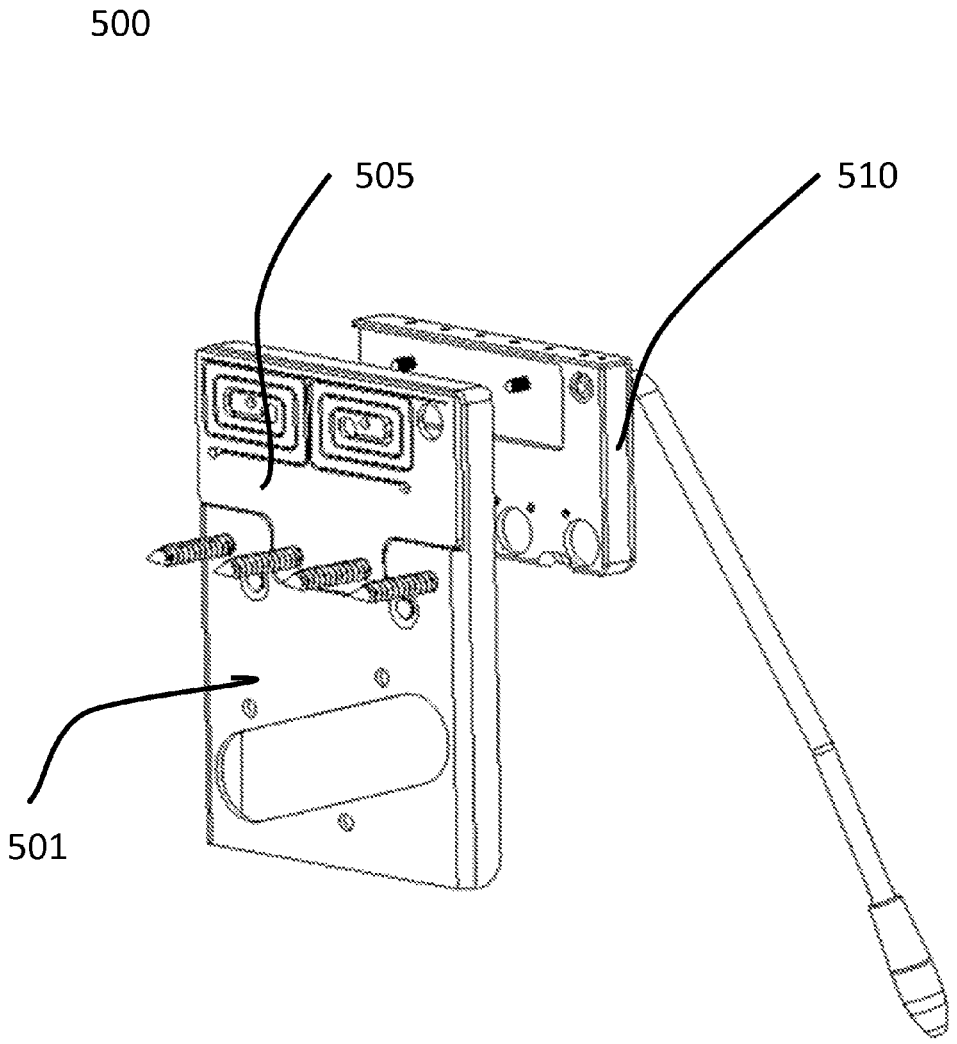
FIG. 5 illustrates a detached pivoting bridge element and mounting plate of the exemplary embodiment of FIG. 4.
Figure 5A:
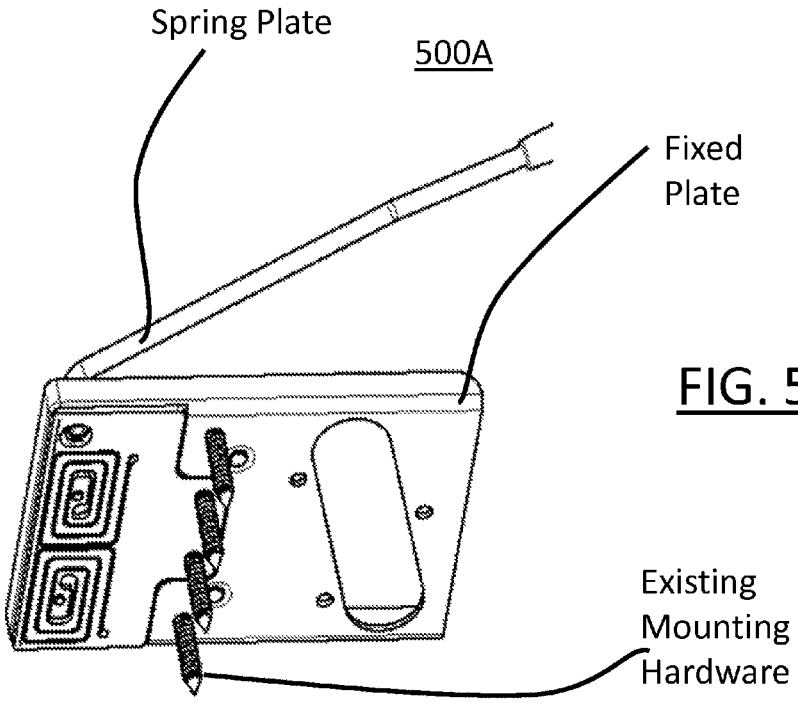
FIG. 5A-C depict exemplary configurations for the pivoting bridge element piece of some possible embodiments of the present invention.
Figure 5B:
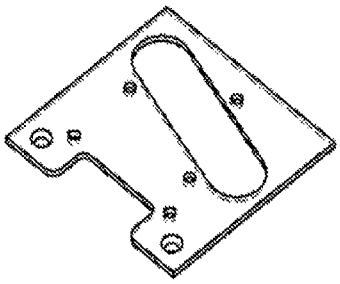
Figure 5C:
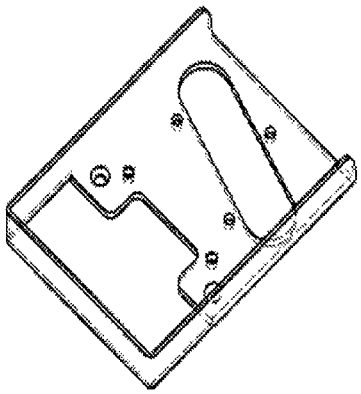

Referring now to FIG. 5, an exemplary embodiment of the pivoting bridge element, 505 and 510, of the vibrato device is depicted separated from the mounting plate 501. At 510 a fixed plate is depicted. In this particular exemplary embodiment the fixed plate can be glued or fixed to a spring plate 505. However, one plate may comprise both the fixed plate and the spring plate as depicted in FIG. 5A at 500A. Other variations can include separate plates which may be attached, screwed, glued or welded. For example, other separate plate configurations that may be used can include configurations depicted in FIG. 5B and 5C at 500B and 500C respectively.

Referring back to FIG. 5, the exemplary two piece component can allow the apparatus to pivot on the said jacking pivot axis bolts allowing the musical instrument's strings to change tune or pitch. The said pivoting bridge element is equipped with clearance holes through the aft surface parallel to the orientation of the said string through the surface parallel to the musical instrument's mounting surface. These holes can allow for the attachment of the spring tension adjustment screws to the pivoting bridge element.

Also in some embodiments, another set of threaded holes through the aft surface perpendicular to the orientation of the said string with the said hole axis being parallel to the axis of the said string may be included. These holes can be designed to receive intonation/mounting screws and said compression springs to constrain the said saddles in the axis being parallel to the axis of the said string. On a surface parallel to the musical instrument's mounting surface there may be clearance holes to allow the said wood screws clearance for head protrusion.

The invention claimed is:

1. A Vibrato Device comprising:

a mounting plate with a top surface and a bottom surface, wherein the mounting plate comprise two or more holes for fixing the bottom surface of the mounting plate to a flat surface of a stringed musical instrument;

a fixing feature protruding out of at least a portion of the top flat surface of the mounting plate used to contain a pivoting bridge element, wherein the pivoting bridge element comprises:

a string fastening mechanism capable of fixing one or more strings to the pivoting bridge element;

a plurality of intonation screws, wherein the plurality of intonation screws and the fixing feature allow for the movement of the pivoting bridge element in relation to the mounting plate;

a first plate comprising one or more flush tension springs, wherein the first plate is positioned parallel to the mounting plate and wherein at least a portion of said first plate is partially in contact with the mounting plate; and a second plate at least partially fixed to the other side of said first plate comprising the string fastening mechanism.

2. The Vibrato Device of claim 1, additionally comprising a whammy bar receptacle on a surface of the pivoting bridge element.

3. The Vibrato Device of claim 1, wherein the string fastening mechanism comprises one or more threaded holes capable of receiving one or more saddles.

4. The Vibrato Device of claim 1, wherein the pivoting bridge element comprises two flush tension springs.

5. The Vibrato Device of claim 1 wherein the pivoting bridge element is composed of steel.

6. The Vibrato Device of claim 1, wherein the pivoting bridge element can rotate on an axis up to about 45 degrees.

7. The Vibrato Device of claim 1, wherein the Vibrato Device is adjustable within a predefined tension range.

8. The Vibrato Device of claim 7, wherein the pivoting bridge element further comprises a plurality of intonation holes located at a plurality of positions, wherein the plurality of intonation holes are configured to receive the plurality of intonation screws, and wherein the plurality of positions limits the predefined tension range.

9. The Vibrato Device of claim 7, wherein the one or more flush tension springs limits the predefined tension range.

* * * * *